United States Patent [19]

Hughes et al.

[11] 4,109,992

[45] Aug. 29, 1978

[54] CONNECTOR FOR COMPRESSOR HEADER

[75] Inventors: Donald Wayne Kent Hughes, Mechanicsburg; Gary Douglas Porta, Shiremanstown, both of Pa.

[73] Assignee: AMP Incorporated, Harrisburg, Pa.

[21] Appl. No.: 822,167

[22] Filed: Aug. 5, 1977

[51] Int. Cl.[2] ..... H01R 19/34

[52] U.S. Cl. ..... 339/147 R; 339/192 RL

[58] Field of Search ..... 339/147 R, 191 R, 191 L, 339/191 A, 191 M, 192 R, 192 RL, 217 S, 223 R, 105

[56] References Cited

U.S. PATENT DOCUMENTS

| | | | |
|---|---|---|---|
| 3,336,567 | 8/1967 | Coldren | 339/192 R |
| 3,917,377 | 11/1975 | Hall et al. | 339/192 RL |

FOREIGN PATENT DOCUMENTS

| | | | |
|---|---|---|---|
| 1,007,275 | 3/1977 | Canada | 339/147 R |

*Primary Examiner*—Roy Lake
*Assistant Examiner*—E. F. Desmond
*Attorney, Agent, or Firm*—Frederick W. Raring; Jay L. Seitchik

[57] ABSTRACT

Electrical connector for connecting two conductors to two terminal pins which extend from a hermetic header comprises an insulating housing having three side-by-side stalls therein. One conductor extends to one of the stalls and is connected by a crimped splice terminal to a lead from a diode which is also contained in the housing. The other lead from the diode extends to another stall and is crimped to a pin-receiving terminal in the other stall. The second conductor extends to the remaining stall and is crimped to a pin-receiving terminal in that stall. The arrangement is such that when a tensile force is applied to the conductors, no force is transmitted to the leads of the diode.

14 Claims, 7 Drawing Figures

Fig. 5
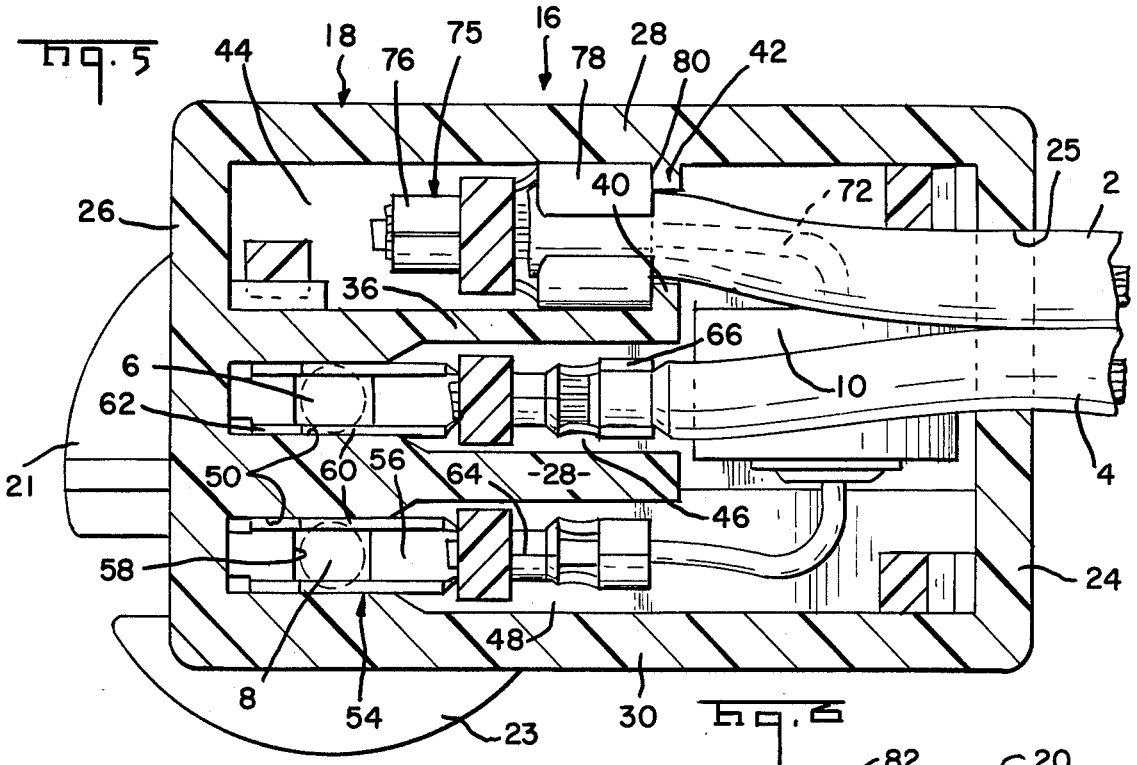
Fig. 6
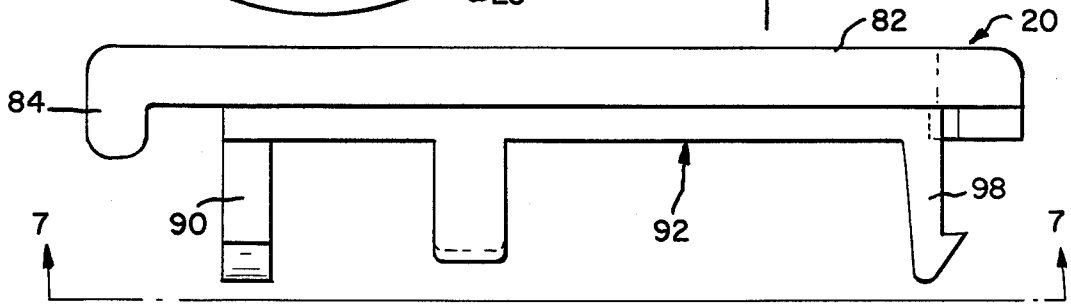
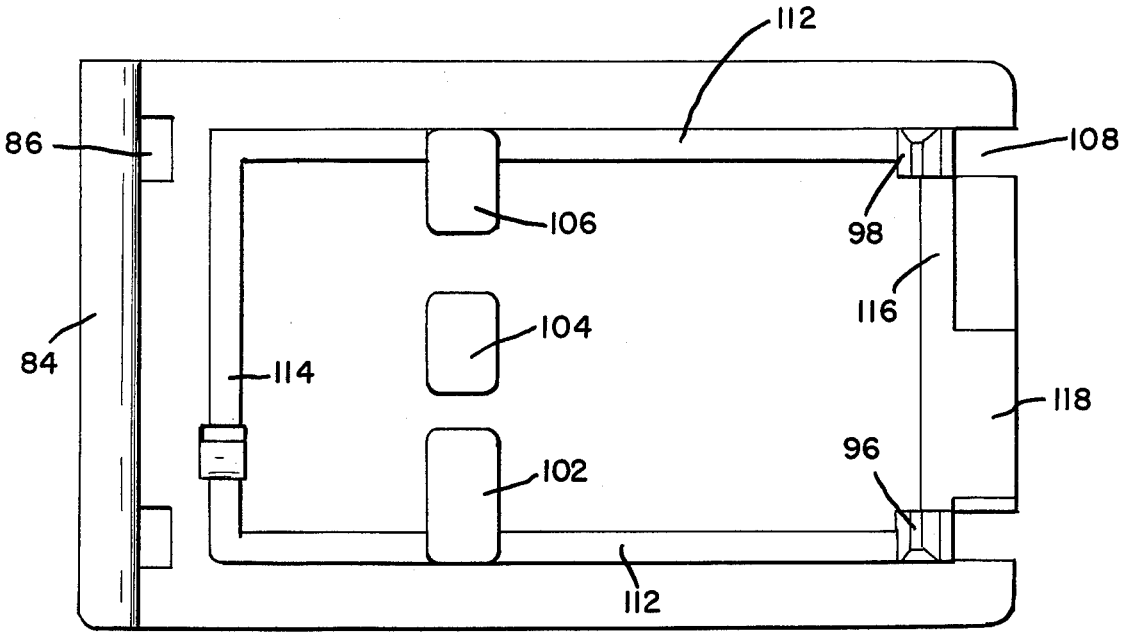
Fig. 7

CONNECTOR FOR COMPRESSOR HEADER

BACKGROUND OF THE INVENTION

This invention relates to electrical connectors of the type used to connect conductors to the contact pins mounted in a hermetic heater of the type used in sealed compressors or other equipment. The invention is particularly directed to the achievement of a tamper proof connector which is adapted to enclose and receive a diode which is connected in series with one of the conductors.

Compressors of the type used for domestic refrigerators are commonly contained in a sealed vessel and the electrical connections required are made by means of hermetic headers which extend through the walls of the vessel. Heretofore, the circuits employed for such compressors required three conductors and the headers were thus provided with three contact pins. The external conductors were electrically connected to these three contact pins by means of specialized connectors of the type shown, for example, in U.S. Pat. Nos. 3,777,302, 3,231,849, and 2,875,426. Conductors of the types shown in these patents were required to be relatively compact and to possess a high degree of reliability for the reason that they were required to give years of service without maintenance or other attention. Compactness was also required of such connectors by reason of the circumstances of their use.

More recently, refrigeration control circuits have been developed which require only two conductors but which also require a diode in series with one of the conductors. The diodes have leads extending therefrom and are relatively delicate in that if the diode leads are subject to abusive or even careless handling, the electrical function of the diode will be destroyed.

The instant invention is directed to the achievement of a connector comprising a housing which receives the two conductors of the circuit and which has provision for the accommodation of the diode in a manner such that the leads of the diode are protected against damage prior to installation of the connector on the header of the compressor. The invention is also directed to the achievement of a connector which is tamper proof in the sense that after the terminals and diode have been placed in the connector, they can not be removed therefrom without destruction of the connector housing. This feature ensures the assembly of an operative and undamaged connector to the header during the assembly process of the refrigerator.

It is accordingly an object of the invention to provide an improved connector for the contact pins of a hermetic header of the type used in compressor enclosures. A further object is to provide an improved connector having provision therein for the accommodation of a circuit component such as a diode. A further object is to provide an improved tamper proof connector which, after it has been installed on conductors, can not be damaged by careless or abusive handling. A further object is to provide an extremely compact connector for a hermetic header which can be used under circumstances where only a very limited amount of space is available.

These and other objects of the invention are achieved in a preferred embodiment thereof which is briefly described in the foregoing abstract, which is described in detail below, and which is shown in the accompanying drawing in which:

FIG. 5 is a cross sectional view taken along the lines 5—5 of FIG. 4.

FIG. 6 is a side view of the cover member of the connector housing.

FIG. 7 is a plan view of the underside of the cover member taken along the lines 7—7 of FIG. 6.

Figure 1:
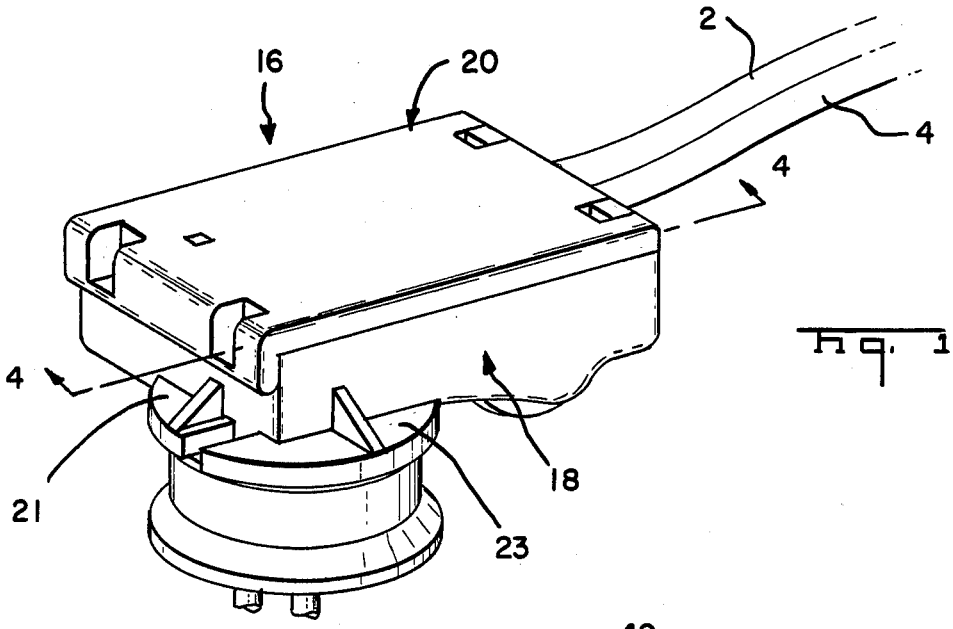
FIG. 1 is a perspective view of a connector in accordance with the invention assembled to a header in a compressor wall.
Figure 3:
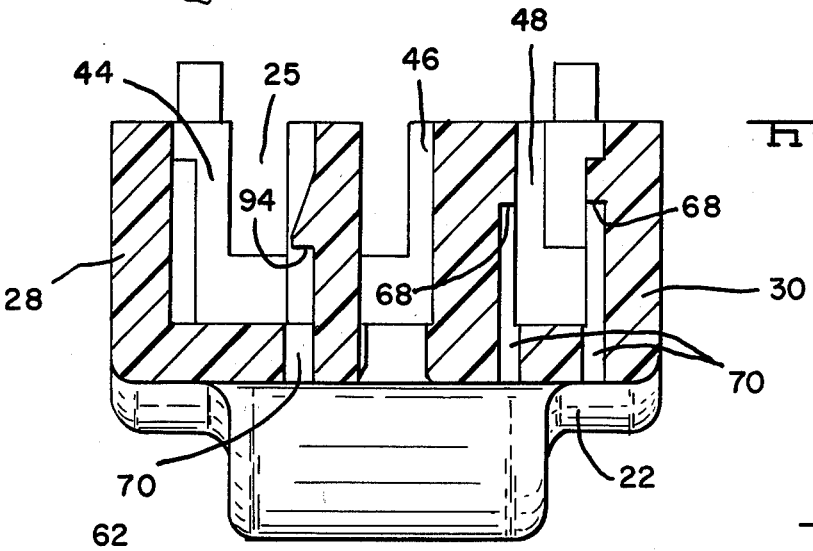
FIG. 3 is a cross sectional view taken along the lines 3—3 of FIG. 2.
Figure 4:
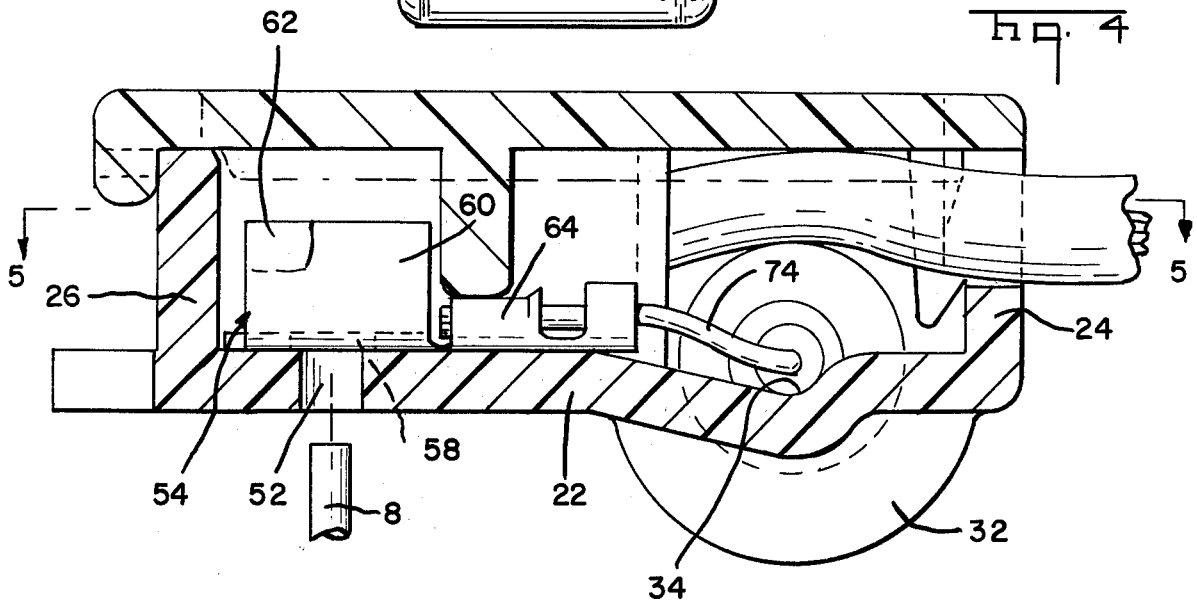
FIG. 4 is a cross sectional view taken along the lines 4—4 of FIG. 1.
Figure 2:
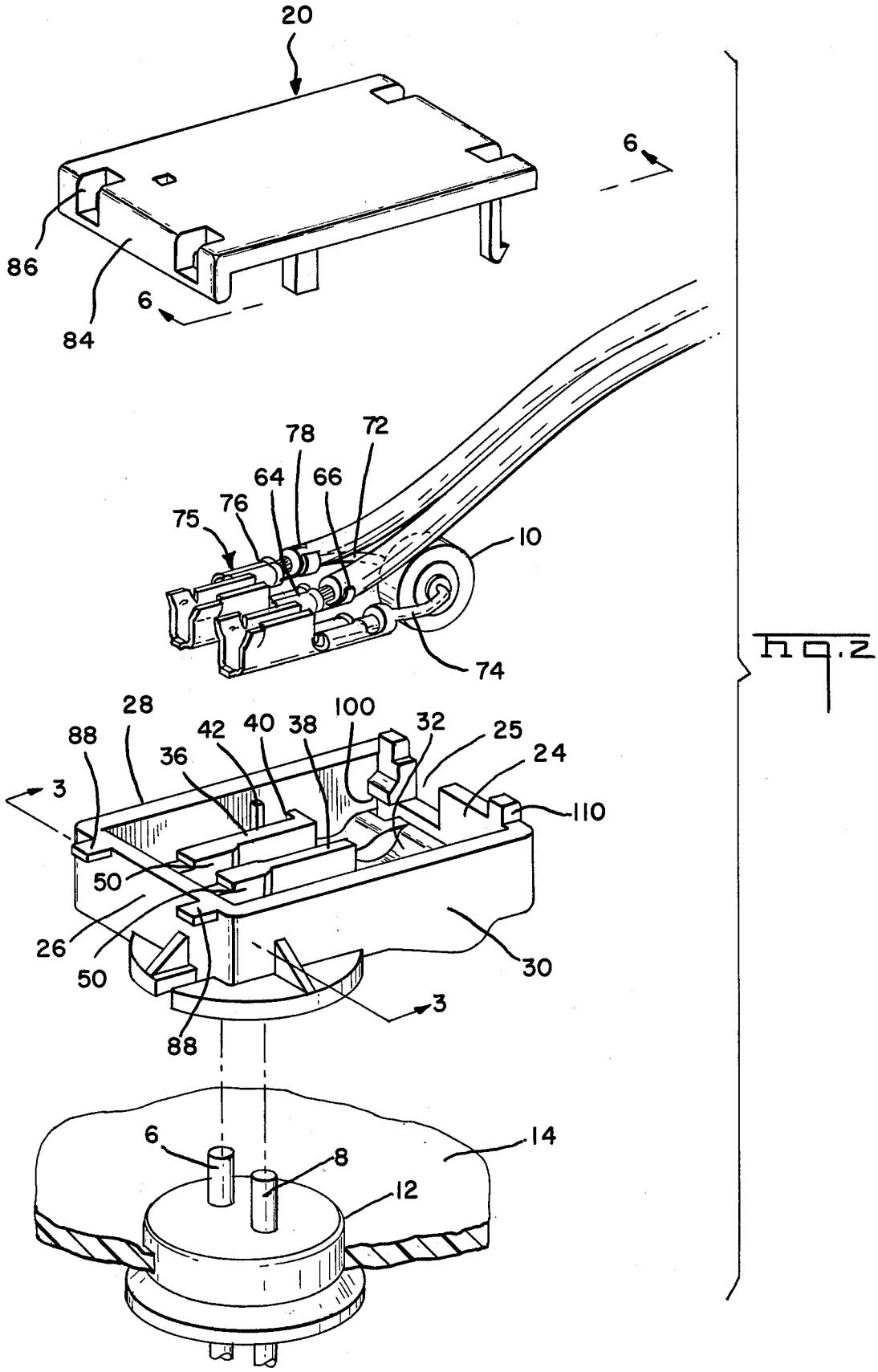
FIG. 2 is an exploded perspective view showing the header, the connector, and the terminals and diode which are contained in the connector housing.

A connector in accordance with the invention serves to connect first and second conductors 2, 4 to first and second pins 6, 8 which extend from the surface of a header 12 which is mounted in an enclosure 14 of a compressor or the like. As will be explained more fully below, the first conductor 2 has a diode 10 in series therewith and the diode is also contained in the connector assembly along with the terminals which receive contact pins 6, 8.

The connector assembly 16 comprises a generally prismatic housing body 18 and a cover member 20 which is assembled to the body after the terminals on the ends of the wires and the diode have been placed in the housing body. The housing body 18 comprises a base portion 22 and upstanding sidewalls 24, 26, 28, and 30. It will be noted that the base has arcuate extensions 21, 23 at the corner defined by the sidewalls 26, 30. These extensions provide protection for the header seal as will be explained below.

The first sidewall 24 has a notch 25 extending inwardly from its upward edge for the reception of the two insulated conductors 2, 4 and thus constitutes a wire-receiving sidewall. A generally cylindrical depression 32 is provided in the base 22 adjacent to the sidewall 24, this depression being dimensioned to receive the generally cylindrical diode 10 to the extent that clearance for the wires 2, 4 is provided between the upper cylindrical surface of the diode and the cover member 20. Relatively shallow depressions 34 are provided on each side of the deep depression 32 for the lead wires 72, 74 which extend from the ends of the diode.

First and second internal barrier walls 36, 38 extend from the sidewall 26, which is opposite to the sidewall 24, towards the sidewall 24 and the barrier wall 36 which is adjacent to sidewall 28 has a laterally projecting extension 40 on its end. This extension is in alignment with a rib 42 which extends from the base along the sidewall 28 so that a constricted entrance is provided to a stall 44, the stall which is defined by the sidewall 28 and the internal barrier wall 36. The stall 44 receives the first conductor and a crimped terminal 75 which connects the first conductor and the diode lead 72. The second and third stalls 46, 48 receive terminals 54. It will be noted that the stalls 46, 48 have relatively narrow portions 50 adjacent to the sidewall 26 and that openings 52 are provided in the floor which communicate with these stalls. The openings having a diameter which is somewhat less than the width of the stalls and are dimensioned to receive the contact pins 6, 8 of the header 12.

The socket terminals 54 which are contained in the stalls 46, 48 are identical and each comprises a web 56 from which sidewalls 60 extend. A central opening 68 is provided in the web or reception of the pins of the contact header 12 and the spacing between the sidewalls is such that electrical contact is established with the pins when they extend through the openings 52 and through the openings 58 in the web portions 56 of the socket terminals. Retention ears 62 are struck from the forward upper portions of the sidewalls 60 of each socket terminal and cooperate with retaining shoulders in the terminal receiving stalls as will be described below. Each socket terminal has a wire crimp portion 64 by means of which it is connected to the conducting core of a wire and an insulation crimp 66. The terminal in the stall 46 is secured directly to the wire 4 and the terminal in the stall 48 is crimped onto the diode lead 74 as shown.

The opposed sidewalls of the stalls 46, 48 are provided with downwardly directed shoulders 68 as viewed in the drawing which bear against the outwardly formed retention ears 62 of the terminals to prevent upward movement of the terminals after they have been inserted into the stalls. These downwardly directed shoulders, and other downwardly directed shoulders described below, are produced at the time of molding the housing body and to this end openings 70 are provided in the base of the housing beneath the downwardly directed shoulders. It will be understood that these openings 70 are produced by the core pins which are required for the shoulders.

The first conductor 2 extends through the opening 25 and into the first stall as previously noted. This conductor is connected by means of a crimped splice terminal 75 to the diode lead 72. As shown in the drawing, the splice terminal has a wire crimp portion 76 which is crimped onto both the end of the conducting core of the wire 2 and the end of the diode lead and an insulation crimp portion 78 which is crimped onto the insulation of the conductor 2 and onto the diode lead 72.

The diode lead is centrally located in the insulation crimp 78 directly beneath the wire and it is midway between the rib 42 and the lateral extension 40 of the barrier wall 36. By virtue of this arrangement, if a tensile pull is applied to the wire 2, the trailing or rearward edge portions of the crimped connection 78 will be pulled against the surfaces of the extension 40 of the rib 42 and the load thus applied to the wire will not be transmitted to the diode lead contained in the crimp connection. As previously mentioned, the diode can be destroyed if the lead 72 or the lead 74 is subjected to a severe or even moderate tensile force or is otherwise disturbed.

The remaining lead 74 which extends from the diode is crimped in the socket terminal contained in the stall 48. However, it will be apparent that under no circumstances could a tensile force be transmitted to the lead 74 and damage to this lead can not, therefore, take place.

The cover member 20 is generally flat and has an external top surface 82 and an underside 92. A flange 84 depends from the cover member at one end thereof and two spaced-apart openings 86 are provided adjacent to this flange. These openings are dimensioned to receive spaced-apart ears 88 which extend from the sidewall 26 of the housing body so that the cover member can be assembled to the body by inserting the ears through the openings and swinging the body downwardly towards the open upper end of the housing body. The cover is permanently latched to the housing by means of latch means 90, 96, and 98, the latch arm 96 being adjacent to the flange 84 and the latch arms 96, 98 being disposed adjacent to the opposite end of the cover. Latch arm 90 extends normally from the underside 92 and has a hook-like end which is dimensioned to engage a downwardly facing shoulder 94 on one of the sidewalls of the stall 44. The latch arms 96, 98 also extend normally from the underside 92 of the cover and have hook portions on their lower ends which are dimensioned to engage shoulders 100 in the body which are provided on the internal surface sidewall 24.

Integral projections 102, 104, 106 extend from the underside 92 of the cover and are dimensioned to be received in the stalls 44, 46, and 48. These projections serve as keepers or stops for the terminals, the conductors, and the crimped terminal in the first stall 46. They are, of course, located such that they do not interfere with the terminal pins in the header when the connector is mated with the header.

A pair of notches 108 are provided in the cover member adjacent to each of the latch arms 96, 98 and these notches receive spaced-apart ears 110 which extend from the ends of the sidewall 24, these notches in cooperation with the ears 88 and openings 86 ensure that the cover member will be properly assembled to the body since the cover member can not be moved against the upper edges of the sidewalls unless the ears are in proper alignment with the notches 108.

Relatively low ribs 112, 114, 116, and 118 extend around the underside surface of the cover and are spaced inwardly from the edges thereof so that these ribs are received within the body when the parts are assembled. It will be noted that the rib 116 has an enlarged portion which is in alignment with the wire-receiving notch 25 so that the wires are clamped between the edge of this enlarged portion of the rib and the inner end of the notch when the connector is assembled.

The connector assembly is installed on the ends of the conductors 2, 4 by first crimping a terminal 54 onto the end of the conductor 4 and then crimping the terminal 75 onto the end of the conductor 2 and onto the end of the diode lead 72. Thereafter, the diode lead 74 is crimped onto a terminal 54 and the two terminals 54 and the terminal 75 are placed in the body portion of the housing. As shown, the diode is seated in the depression 32 with the conductors 2, 4 extending through the notch 25 and over the upper end or surface of the diode. The cover member is then assembled to the housing body by inserting the ears 88 through the openings 86, and swinging the cover downwardly until the latch arms move into the interior of the housing body and engage their corresponding shoulders. After this assembly operations has been carried out, it is impossible to remove the cover member without destroying the housing and rendering it useless for its intended purpose. Under the circumstances of use of this conductor, this feature is desirable for the reason that the diode is subject to damage by careless handling or unauthorized tampering and any such tampering with the instant connector would be immediately apparent. After the connector assembly has been tested then, the manufacturer can mate it with the pins from the hermetic header with full assurance that it will serve its intended function.

As shown in the drawing, the surface of the enclosure 16 for the compressor is generally spherical and the projecting bulge on the base 22 of the housing formed by the depression 32 can be and is accommodated adjacent to the header. The previously described arcuate extensions 21, 23 of the floor or base of the housing extend over the surface of the header and, thereby, protect the seal of the pins to the header against damage which may result from impingement or a blow directed against the header.

What is claimed is:

1. The combination of two wires, a diode in series with one of said wires, and an electrical connector for connecting said wires to terminal posts;

said connector comprising an insulating housing having a base and sidewalls surrounding said base, said wires extending through one of said sidewalls, said diode being contained in said housing and having two leads extending therefrom, a splice terminal in said housing, said splice terminal being crimped onto one of said wires and one of said leads, two socket terminals in said housing, one of said socket terminals being crimped onto the other one of said wires, the other one of said socket terminals being crimped onto the other one of said diode leads, openings in said housing for reception of said terminal posts whereby said connector can be mated with said terminal posts and said socket terminals will receive said posts, and strain relief means in said housing in engagement with said splice terminal for preventing transmission of tensile forces applied to said wire to said one diode lead.

2. The combination set forth in claim 1, said housing having three side-by-side stalls therein, said splice terminal and said socket terminals being disposed in said stalls.

3. The combination set forth in claim 2, said base of said insulating housing having a depression therein, said diode being disposed in said depression.

4. The combination set forth in claim 3, said depression being between said one of said sidewalls and said stalls.

5. The combination set forth in claim 4, said socket terminals being generally U-shaped and having a web and sidewalls extending from said web, said webs of said terminals being parallel to said base of said housing, said web of each terminal having an opening therein for one of said pins, said openings in said housing being in said base of said housing and being in alignment with said openings in said webs of said socket terminals.

6. The combination set forth in claim 1, said housing having a separate cover member which extends parallel to said base, latching means for securing said cover member to said housing, said latching means being within said housing.

7. An electrical conductor attached to the ends of first and second wires, said connector comprising a generally prismatic insulating housing body having a base, sidewalls surrounding said base, and having an open top, a first one of said sidewalls constituting a wire-receiving sidewall, a second sidewall which is opposite to said first sidewall, first and second internal barrier walls extending from said second sidewall towards said first sidewall, said barrier walls defining first, second, and third side-by-side stalls in said housing, said first and second wires extending through said wire-receiving wall and to said first and second stalls respectively, a circuit component in said housing body between said stalls and said wire-receiving wall, said component having one lead wire extending therefrom to said first stall, said one lead being connected to said first wire, said component having another lead extending therefrom to said third stall, said second wire and said other lead being connected to electrical terminals in said second and third stalls, openings in said base of said housing body communicating with said second and third stalls, said openings and said terminals being dimensioned to receive contact pins whereby, said wires are connected to said pins, and cover means for said housing body, said cover means and said housing body having interengaging means for securing said cover means to said housing body.

8. The combination set forth in claim 7, said circuit component being cylindrical, said leads extending from the ends of said component, said base of said housing body having a generally cylindrical depression therein adjacent to said wire-receiving sidewall, said component being in said depression and said first and second wires extending between said component and said cover.

9. The combination set forth in claim 8, said interengaging means comprising latch arms extending normally from said cover means, said latch arms being received within said housing body, and latch ear means within said housing body, said latch ear means being cooperable with said latch arms to secure said cover means to said housing body.

10. An electrical connector housing which is intended to receive two wires, two socket terminals, a diode, and a splice terminal, said housing comprising:

a base having sidewalls extending therefrom, said sidewalls defining an enclosure, a first one of said sidewalls constituting a wire-receiving sidewall, a second sidewall which is opposite to said first sidewall, two internal barrier walls extending from said second sidewall towards said first sidewall, said barrier walls defining three side-by-side stalls, said enclosure providing clearance adjacent to said first sidewall for said diode and for said two wires to permit said wires to extend past said diode and to said stalls whereby, upon crimping a splice terminal onto one of said two wires and one lead of the said diode, crimping the other lead of said diode onto one receptacle terminal, and crimping the other wire onto the other receptacle terminal, said splice terminal, said receptacle terminals, and said wires can be placed in said stalls with said diode between said stalls and said first sidewall.

11. A housing is set forth in claim 10, said housing having a separate cover member which is dimensioned to fit against upper edge portions of said sidewalls, interengaging means effective between said cover and said housing for securing said cover to said housing.

12. A housing as set forth in claim 11, said interengaging means comprising latch arm and shoulder means, said interengaging means being entirely within said enclosure when said cover is assembled to said sidewalls whereby said housing is tamper proof.

13. A housing as set forth in claim 10 having strain relief shoulder means in said enclosure, said strain relief shoulder means being engageable with portions of said spliced terminal thereby to provide a strain relief for said one wire and to prevent transmission of tensile forces applied to said one wire to said diode lead.

14. An electrical connector housing assembly which is intended for use with the hermetic header having spaced-apart first and second terminal pins extending therefrom, said housing assembly comprising:

a housing body and a cover member, said housing body being generally prismatic and having a base and upstanding sidewalls surrounding said base, one of said sidewalls having a wire-receiving opening therein and constituting a wire-receiving sidewall, another sidewall which is opposite to said wire-receiving sidewall having first and second internal barrier walls extending therefrom towards said wire-receiving sidewall, said barrier walls defining three side-by-side stalls, a depression in said base adjacent to said wire-receiving sidewall, said depression being dimensioned to receive a diode, said cover means and said housing body having interengaging means for securing said cover to said body, two of said stalls being dimensioned to receive contact terminals which are intended for mating with said contact pins, said two stalls having openings in said base for reception of those said pins whereby, said two conductors can be connected to said pins with said diode in series with one of said conductors upon crimping a terminal onto one lead from said diode and onto one of said conductors, crimping a terminal onto the other lead from said diode, and crimping a pin receiving terminal onto the other one of said conductors, placing said terminals in said terminal receiving stalls and placing said splice terminal in the remaining stall, and locating said diode in said recess whereby, said pins from said header will be connected to said terminals upon mating said connector with said pins.

* * * * *